US007178842B2

(12) United States Patent
Wheatland

(10) Patent No.: US 7,178,842 B2
(45) Date of Patent: Feb. 20, 2007

(54) PUSH BUTTON LOCK MECHANISM FOR A HANDLE SET

(75) Inventor: Graham John Wheatland, Rancho Santa Margarita, CA (US)

(73) Assignee: Newfrey, LLC, Newark, DE (US)

( * ) Notice: Subject to any disclaimer, the term of this patent is extended or adjusted under 35 U.S.C. 154(b) by 151 days.

(21) Appl. No.: 10/939,615

(22) Filed: Sep. 13, 2004

(65) Prior Publication Data

US 2006/0055183 A1 Mar. 16, 2006

(51) Int. Cl.
*E05B 3/00* (2006.01)
*E05B 1/00* (2006.01)

(52) U.S. Cl. ..... 292/336.3; 292/169.18; 292/347; 292/356; 292/357; 70/224

(58) Field of Classification Search ..... 292/336.3, 292/DIG. 24, DIG. 37, 347, 169.18, 356–359; 70/480–482, 467, 468, 224
See application file for complete search history.

(56) References Cited

U.S. PATENT DOCUMENTS 2,038,907 A * 4/1936 Schlage ..... 292/169.22
2,242,508 A * 5/1941 Ching ..... 292/169.18
2,299,180 A * 10/1942 Schlage ..... 292/169.18
2,366,934 A * 1/1945 Schlage ..... 70/152
2,912,846 A * 11/1959 Schweitzer ..... 70/216
2,998,273 A 8/1961 Unetic ..... 292/169
3,022,102 A * 2/1962 Russell et al. ..... 292/169.18
3,079,189 A * 2/1963 Russell et al. ..... 292/359
3,128,112 A * 4/1964 Fryer ..... 292/169.16
3,823,585 A 7/1974 Spon ..... 70/146
4,470,278 A 9/1984 Hale et al. ..... 70/134
4,470,279 A 9/1984 Neary et al. ..... 70/134
4,920,773 A * 5/1990 Surko, Jr. ..... 70/224
4,966,399 A * 10/1990 Lin ..... 292/359
4,998,760 A 3/1991 Nixon et al. ..... 292/347
5,125,696 A 6/1992 Robida et al. ..... 292/169.16
5,232,255 A * 8/1993 Palmer et al. ..... 292/336.3
5,284,372 A * 2/1994 Lin ..... 292/336.3
5,335,950 A 8/1994 Mirshafiee et al. ..... 292/356
5,441,318 A 8/1995 Ghostley ..... 292/336.3
5,460,417 A * 10/1995 Zuckerman ..... 292/175
5,481,890 A 1/1996 Millman ..... 70/224
5,564,296 A 10/1996 Theriault et al. ..... 70/224
5,598,726 A 2/1997 Cordle ..... 70/224

(Continued)

*Primary Examiner*—Brian E. Glessner
*Assistant Examiner*—Carlos Lugo
(74) *Attorney, Agent, or Firm*—Richard J. Veltman, Esq.; Taylor & Aust, P.C.; Ronald K. Aust, Esq.

(57) ABSTRACT

A handle set includes a handle assembly having an operator, a rose insert, and a shank having a bore. The rose insert has a central opening and a post. The shank is affixed to the operator and rotatably received in the central opening. A rotational stop is coupled to the rose insert. A spindle guide is slidably received in the bore and is slidable between a locked position and an unlocked position. A kick-off plate having a retention slot is coupled to the spindle guide. A centralizing cup having a single multi-function tang and a lock retention feature is mounted to the shank. The multi-function tang is configured for rotation along a rotational path, the rotation being limited by the rotational stop. The lock retention feature is positioned to engage the retention slot when the spindle guide is in the locked position to thereby retain it in the locked position.

3 Claims, 5 Drawing Sheets

U.S. PATENT DOCUMENTS 5,727,406 A 3/1998 Banducci ..... 70/224
5,784,909 A * 7/1998 Huang ..... 70/224
5,816,086 A * 10/1998 Russell, IV ..... 70/422
5,992,189 A * 11/1999 McCaa ..... 70/149
6,425,273 B1 * 7/2002 Kim et al. ..... 70/224
6,623,053 B1 * 9/2003 Hwang ..... 292/336.3
6,860,529 B2 * 3/2005 Chong et al. ..... 292/169.18

* cited by examiner

PUSH BUTTON LOCK MECHANISM FOR A HANDLE SET

BACKGROUND OF THE INVENTION

1. Field of the Invention

The present invention relates to a handle set, and, more particularly, to a push button lock mechanism for a handle set.

2. Description of the Related Art

Locking handle sets, or locksets, have long been available for commercial and home use. Among the most popular for home and small business use are tubular and cylindrical locksets. Tubular locksets are fairly simple in nature, requiring a small number of parts/features, thus providing a sturdy, yet reliable and low cost design. Cylindrical designs are more complex than tubular designs, and are thus more expensive to produce, due to the number of parts/features involved, as well as due to the tolerancing required to maintain a high reliability. Cylindrical locksets, by their nature, are readily adapted for push button locking, in which a person simply pushes a button located at the center of the operator in order to lock the handle set. This convenient method of locking a handle set has been difficult to implement in a tubular lockset design without substantially increasing the number of parts, and hence, the cost of the handle set.

What is needed in the art is a push button lock mechanism for a handle set that has a reduced number of parts.

SUMMARY OF THE INVENTION

The present invention provides a push button lock mechanism for a handle set.

The invention, in one form thereof, relates to a handle set. The handle set includes a handle assembly having an operator, a rose insert, and a shank having a bore. The rose insert has a central opening and a post, and the shank is affixed to the operator and rotatably received in the central opening. The handle set also includes a rotational stop coupled to the rose insert, and a spindle guide slidably received in the bore. The spindle guide is slidable between a locked position and an unlocked position. The handle additionally includes a kick-off plate having a retention slot, the kick-off plate being coupled to the spindle guide, and a centralizing cup mounted to the shank. The centralizing cup has a single multi-function tang and a lock retention feature. The multi-function tang is configured for rotation along a rotational path, wherein rotation of the multi-function tang along the rotational path is limited by the rotational stop. The lock retention feature is positioned to engage the retention slot of the kick-off plate when the spindle guide is in the locked position to thereby retain the spindle guide in the locked position.

The invention, in another form thereof, relates to a method of operating a push-button lock mechanism in a handle set. The method includes pushing a lock button to cause a spindle guide having a kick-off plate coupled thereto to slide into a locked position to lock the handle set. The kick off plate has a retention slot in engagement with a lock retention feature of a centralizer cup to thereby retain the spindle guide in the locked position. The method also includes turning the operator to cause the kickoff plate to kick off of a locking cup to drive the spindle guide into an unlocked position, thereby overcoming the lock retention feature engagement with the retention slot and unlocking the handle set. A rotational stop is engaged by a multi-function tang of the centralizer cup to limit rotation of the operator.

An advantage of the present invention is that the cost of a handle set may be reduced by reducing the number of parts in the handle set.

Another advantage is that the reliability of the handle set may be increased by reducing the number of parts in the handle set.

BRIEF DESCRIPTION OF THE DRAWINGS

The above-mentioned and other features and advantages of this invention, and the manner of attaining them, will become more apparent and the invention will be better understood by reference to the following description of one exemplary embodiment of the invention taken in conjunction with the accompanying drawings, wherein.

Corresponding reference characters indicate corresponding parts throughout the several views. The exemplifications set out herein illustrate one exemplary embodiment of the invention, and such exemplifications are not to be construed as limiting the scope of the invention in any manner.

DETAILED DESCRIPTION OF THE INVENTION

Figure 1:
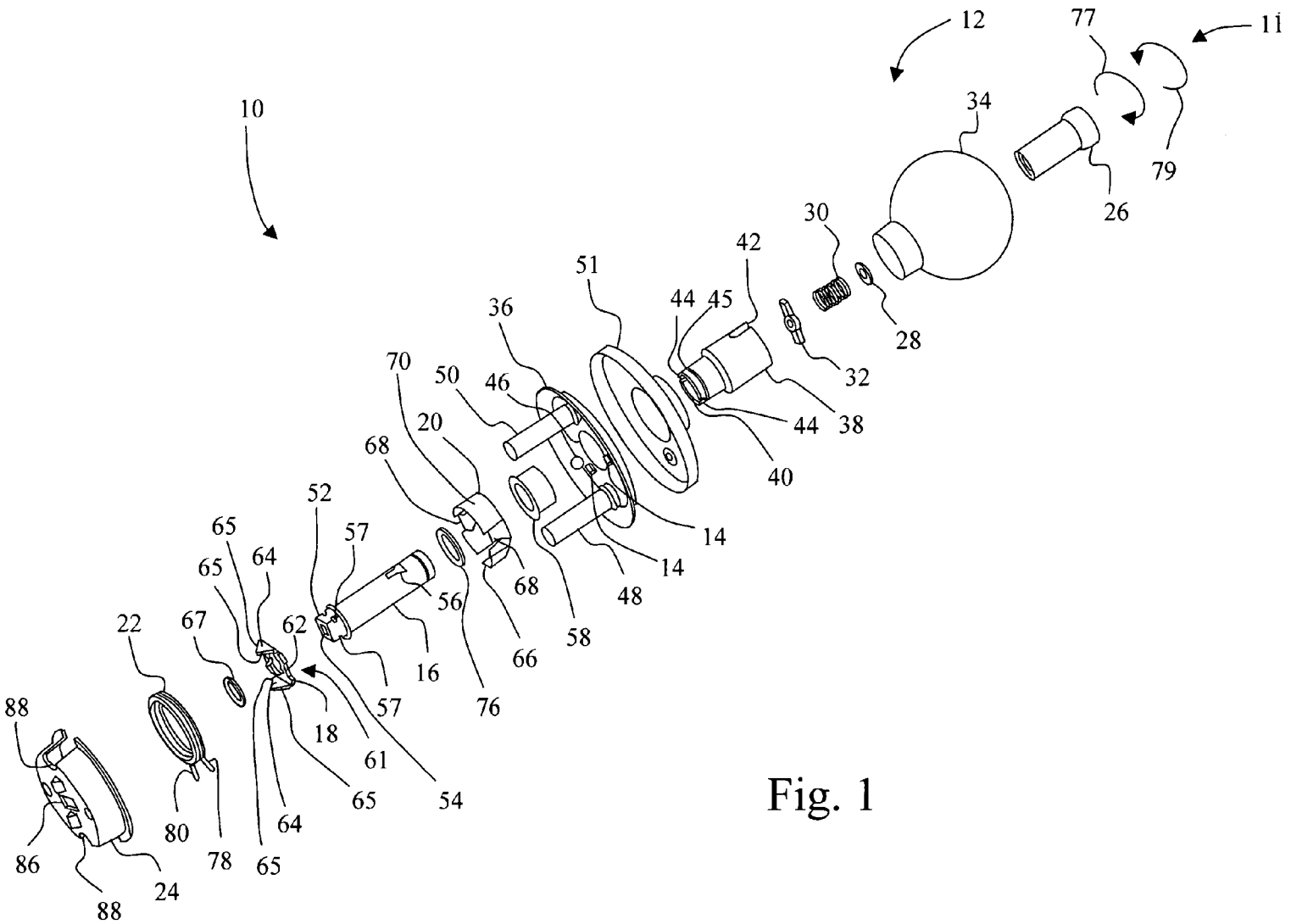
FIG. 1 is an exploded perspective view of an embodiment of a handle set in accordance with the present invention.

Referring now to the drawings and particularly to FIG. 1, there is shown a handle set 10 embodying the present invention. Handle set 10 includes a push button lock mechanism 11 and a handle assembly 12 exemplified as an inside handle assembly. Handle set 10 also includes other components (not shown), such as, for example, a door latch bolt and actuation mechanism, and an outside handle assembly for use on the opposite side of a door (not shown), which for brevity will not be discussed herein, since such components are well known to those of ordinary skill in the art, and their description is not necessary to the understanding of the present invention.

Push button lock mechanism 11 includes two rotational stops 14, a spindle guide 16, a kick-off plate 18, a centralizing cup 20, a torsion spring 22, a locking cup 24, and a lock button 26.

Handle assembly 12 is for use by a person in latching or unlatching, locking or unlocking, and opening or closing the door. Handle assembly 12 includes a retaining ring 28, a shock absorbing spring 30, a keyed function plate 32, an operator 34, a rose insert 36, a shank 38 having a bore 40, a keyed plate slot 42, a cup locating slot 44, and a groove 45. Each of keyed plate slot 42 and cup locating slot 44 are perpendicular to and passing through bore 40. Rose insert 36 has a central opening 46, a post 48, a post 50, and a rose 51. Rose 51 is positioned over rose insert 36, and serves as a decorative trim. Operator 34 is configured to be readily grasped by the human hand. Shank 38 is affixed to operator 34 using methods known in the art, and is rotatably received in central opening 46 of rose insert 36. Post 48 and post 50 are used to install handle set 10 onto the door.

Rotational stops 14 are coupled to rose insert 36, for example, mounted on or formed integral with rose insert 36.

Spindle guide 16 includes a locking feature 52 through which passes a hole 54, an irregular opening 56 perpendicular to and passing through hole 54, and an interrupted groove 57. In the embodiment depicted, locking feature 52 is in the form of a square-shaped extension of spindle guide 16; those skilled in the art would appreciate that any suitable shape may be used in place of the square shape. Spindle guide 16 is slidably received into bore 40 of shank 38 via a bushing 58 provided for smooth and quite operation of handle set 10. Spindle guide 16 is slidable between a locked position and an unlocked position. When in the locked position, spindle guide 16 is prevented from rotation, as discussed below. The outside handle assembly (not shown) is rotationally coupled with spindle guide 16 by a spindle (not shown) in a manner known in the art. Thus, when spindle guide 16 is in the locked position, the spindle of outside handle assembly may not be turned, and hence, handle set 10 is locked. In the embodiment shown, hole 54 is square-shaped, and is intended to receive a square-shaped spindle.

Keyed function plate 32 is received into both irregular opening 56 of spindle guide 16 and into keyed plate slot 42, and maintains a certain rotational alignment of spindle guide 16 with shank 38, depending on whether spindle guide 16 is in a locked or an unlocked position. Irregular opening 56 is configured such that when spindle guide 16 is in the locked position, a permissible rotation of shank 38 with respect to spindle guide 16, for example, 20 degrees, is provided by a circumferential clearance between irregular opening 56 and keyed function plate 32. As set forth below, this permissible rotation allows handle set 10 to be unlocked.

Irregular opening 56 is also configured such that when spindle guide 16 is in the unlocked position, there is no appreciable circumferential clearance between irregular opening 56 and keyed function plate 32, other than manufacturing tolerances or wear. Thus, when in the unlocked position, spindle guide 16 is rotationally affixed to shank 38 via keyed function plate 32 engaging keyed plate slot 42 and irregular opening 56.

Shock absorbing spring 30 is received into bore 40 and retained in place by retaining ring 28 installed into hole 54. Shock absorbing spring 30 biases spindle guide 16 towards the unlocked position by acting against keyed function plate 32, which acts against the bottom of keyed plate slot 42.

Figure 2:
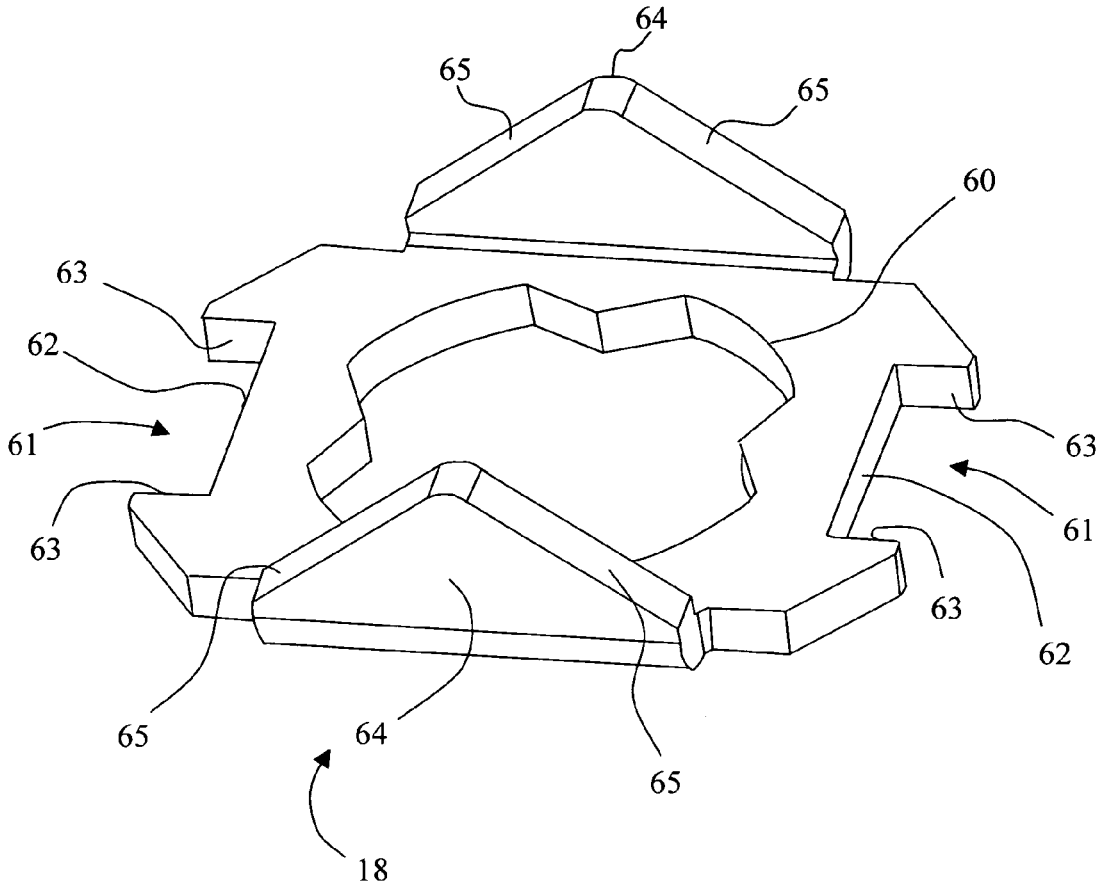
FIG. 2 is an enlarged perspective view of a kick-off plate employed in the embodiment of FIG. 1.

Referring now to FIG. 2, kick-off plate 18 is depicted. Kick-off plate 18 is an unlocking feature of push button lock mechanism 11 that drives spindle guide 16 into the unlocked position, when operator 34 is turned, by "kicking off" of, i.e., pushing away from, locking cup 24. In addition, kick-off plate 18 retains spindle guide 16 in the locked position when operator 34 is not turned. Accordingly, kick-off plate 18 includes a lazy motion aperture 60, two retention slots 61, each of which includes a retention surface 62 and two sidewalls 63, and ramped kick-off tabs 64, each of which includes two ramped surfaces 65.

Referring again to FIG. 1, kick-off plate 18 is coupled to spindle guide 16, with locking feature 52 extending through lazy motion aperture 60, and retained axially with respect to spindle guide 16 by a retaining ring 67. Kick-off plate 18 is free to rotate with respect to spindle guide 16 except as limited by lazy motion aperture 60. Lazy motion aperture 60 is configured to allow a limited rotation of kick-off plate 18 with respect to locking feature 52. For example, in the embodiment depicted, lazy motion aperture 60 is in the form of a four lobed opening, with the lobes sized to allow a relative 20 degree rotation of kick-off plate 18 with respect to locking feature 52, hence with respect to spindle guide 16.

Figure 3A:
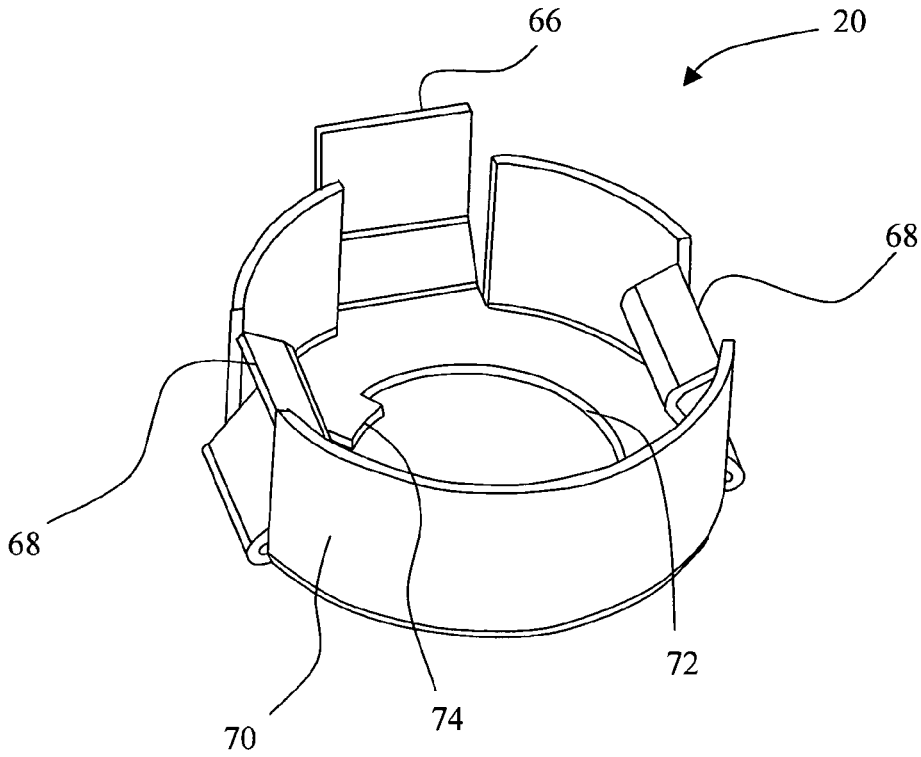
FIGS. 3A and 3B are top and bottom perspective views, respectively, of a centralizing cup employed in the embodiment of FIG. 1.
Figure 3B:
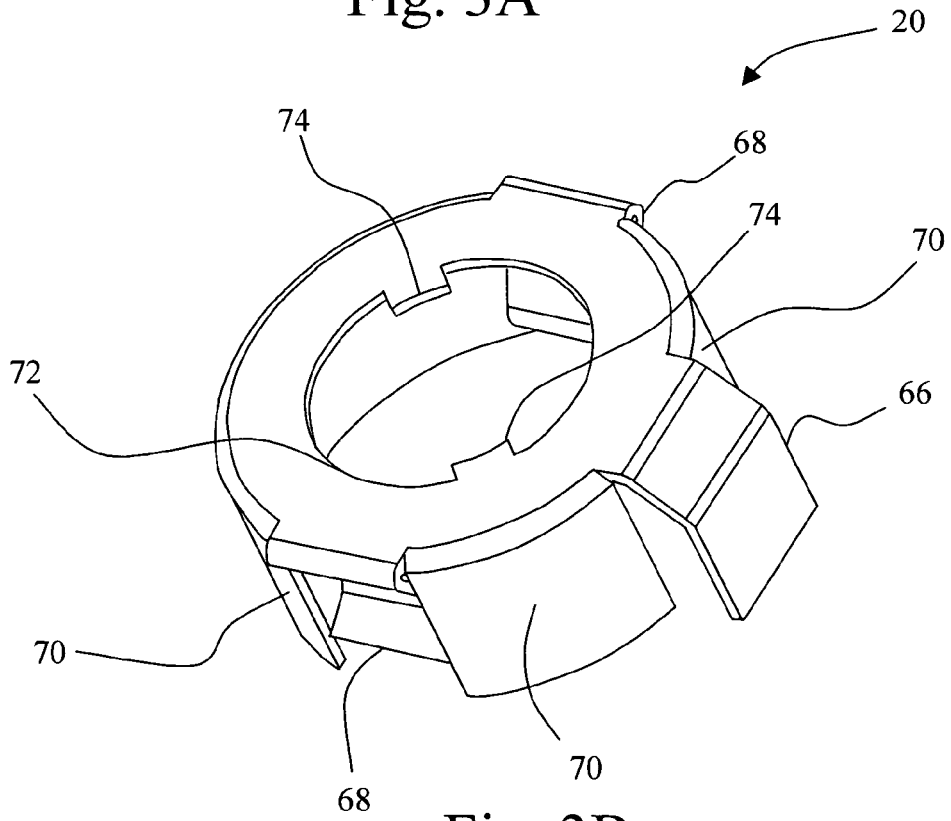

Referring now to FIGS. 3A and 3B, centralizing cup 20 includes a single multi-function tang 66, a lock retention feature 68 in the form of two snap fingers, an outer surface defining a mandrel 70, and an opening 72 having two keys 74 formed integral therewith. Centralizing cup 20 is mounted onto shank 38, with keys 74 fitting into and engaging cup locating slot 44 of shank 38 to anti-rotate centralizing cup 20 with respect to shank 38, thereby rotationally coupling centralizing cup 20 with shank 38, and hence, with operator 34 that is affixed to shank 38. Centralizing cup 20 is retained in place by a retaining ring 76 installed into groove 45.

Multi-function tang 66 is configured for rotation along a rotational path, e.g., when operator 34 is turned to open the door or unlock handle set 10, in the directions indicated by direction arrow 77 and by direction arrow 79 as depicted in FIG. 1. The rotation of multi-function tang 66 in either direction along the rotational path is limited by its engagement with rotational stops 14, thus preventing operator 34 from being turned more than an amount predetermined by the location of rotational stops 14 and the width of multi-function tang 66, e.g., 45 degrees in each direction from a central position.

Lock retention feature 68 is positioned to engage each retention surface 62 of retention slots 61 when spindle guide 16 is in the locked position, thereby retaining spindle guide 16 in the locked position. In addition, whether in the locked or unlocked position, or in-between, lock retention feature 68 engages sidewalls 63 of retention slots 61, thereby rotationally coupling kick-off plate 18 and centralizing cup 20. Thus, an amount rotation of centralizing cup 20 results in a similar amount of rotation of kick-off plate 18. Because centralizing cup 20 is rotationally coupled to shank 38, which is affixed to operator 34, a rotation of operator 34 similarly results in a rotation of kick-off plate 18.

Referring again to FIG. 1, torsion spring 22 has a first end 78 and a second end 80, and is piloted by mandrel 70. Torsion spring 22 is configured to return operator 34 to a central position when operator 34 is released, e.g., after the door is opened, wherein each of end 78 and end 80 are in at least proximal engagement with both multi-function tang 66 and post 48 to thereby centralize operator 34.

The centralizing of operator 34 is now described: when operator 34 is turned in a first direction, e.g., clockwise view from the perspective of a person grasping operator 34 to open the door, multi-function tang 66 rotates clockwise. This rotates end 78 of torsion spring 22 in the clockwise direction, away from post 48 and end 80, winding torsion spring 22 in the clockwise direction. When operator 34 is released, torsion spring 22 unwinds to thereby centralize said operator 34 by acting against multi-function tang 66 with end 78, while end 80 is restrained by post 48. Operator 34 is centralized when end 78 reaches and engages post 48.

Similarly, when operator 34 is turned in a second direction, e.g., counterclockwise, multi-function tang 66 rotates in a counterclockwise direction, thereby rotating end 80 counterclockwise away from post 48 and end 78, winding torsion spring 22 in the counterclockwise direction, such that when operator 34 is released, torsion spring 22 unwinds to thereby centralize operator 34 by acting against multi-function tang 66 with end 80, while end 78 is restrained by post 48. Operator 34 is centralized when end 80 reaches and engages post 48.

Figure 4A:
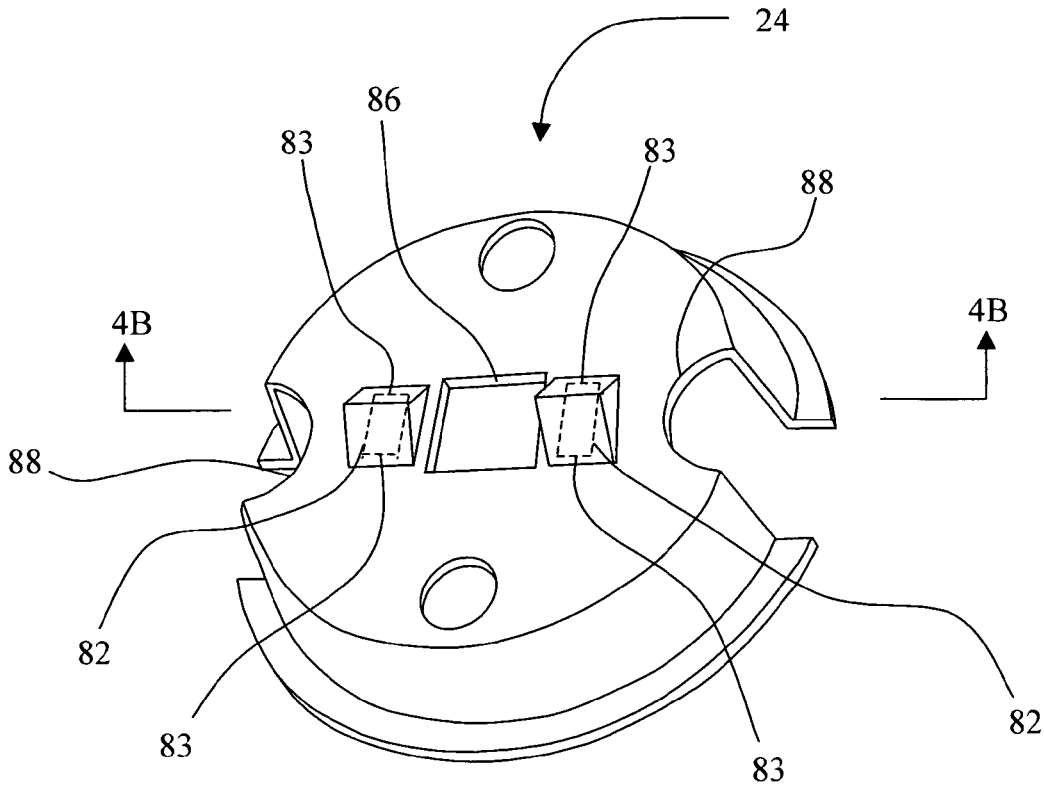
FIGS. 4A is a perspective view of a locking cup in accordance with the embodiment of FIG. 1.
Figure 4B:
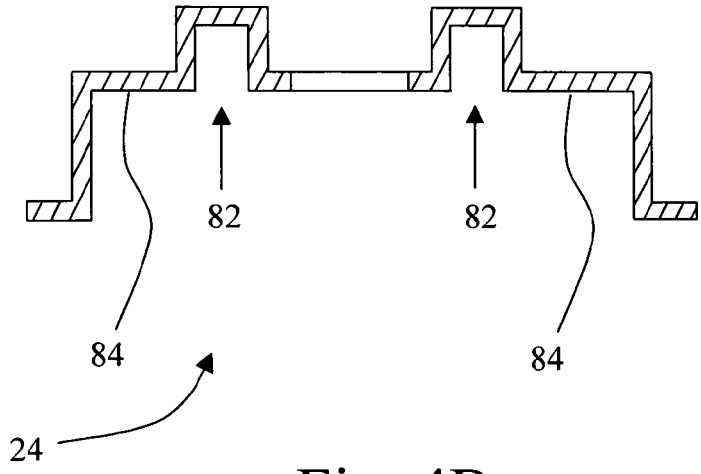
FIG. 4B is a section view of the locking cup of FIG. 4A, taken along line 4B—4B.

Referring now to FIGS. 4A and 4B, locking cup 24 includes kick-off slots 82, each of which has two slot ends 83, a kickoff surface 84, a spindle anti-rotation feature 86, and two post holes 88. Locking cup 24 is mounted on rose insert 36 in a conventional manner known in the art. In the embodiment shown, kick-off slots 82 are formed in kick-off surface 84 by extrusion, although kick-off slots 82 may be formed by any means known in the art, such as by punching or machining. Locking feature 52 of spindle guide 16 is configured to engage spindle anti-rotation feature 86 when spindle guide 16 is in the locked position to thereby lock handle set 10. For example, in the embodiment shown, locking feature 52 is in the form of a square protrusion, whereas spindle anti-rotation feature 86 is in the form of a square hole that is slightly larger than locking feature 52. When the square protrusion of locking feature 52 engages the square hole of spindle anti-rotation feature 86, rotation of spindle guide 16 is prevented, thereby locking handle set 10. When spindle guide 16 is in the locked position, ramped kick-off tabs 64 are at least partially disposed in kick-off slots 82.

Lock button 26 is coupled to spindle guide 16, whereby pushing lock button 26 slides spindle guide 16 into the locked position, i.e., drives locking feature 52 into engagement with spindle anti-rotation feature 86, thus preventing rotation of spindle guide 16, hence the spindle of outside handle assembly, thus locking handle set 10. Kick-off plate 18 and locking cup 24 are configured such that turning operator 34 a limited amount, for example, 20 degrees, rotates kick-off plate 18 via lock retention feature 68 of centralizing cup 20 engaging sidewalls 63 to force ramped kick-off tabs 64 to depart kick-off slots 82, e.g., by the action of ramped surfaces 65 pushing off kickoff surface 84 at slot ends 83. This action of ramped surfaces 65 thrusts kick-off plate 18 away from kickoff surface 84, overcoming the engagement of lock retention feature 68 with retention slots 61, and driving spindle guide 16 into the unlocked position, aided by the biasing force of shock absorbing spring 30.

Operator 34 is capable of turning the limited amount, e.g., 20 degrees, as required to sufficiently rotate kick-off plate 18 to unlock push button lock mechanism 11/handle set 10, due to the aforementioned circumferential clearance between irregular opening 56 and keyed function plate 32 when spindle guide 16 is in the locked position.

Figure 5:
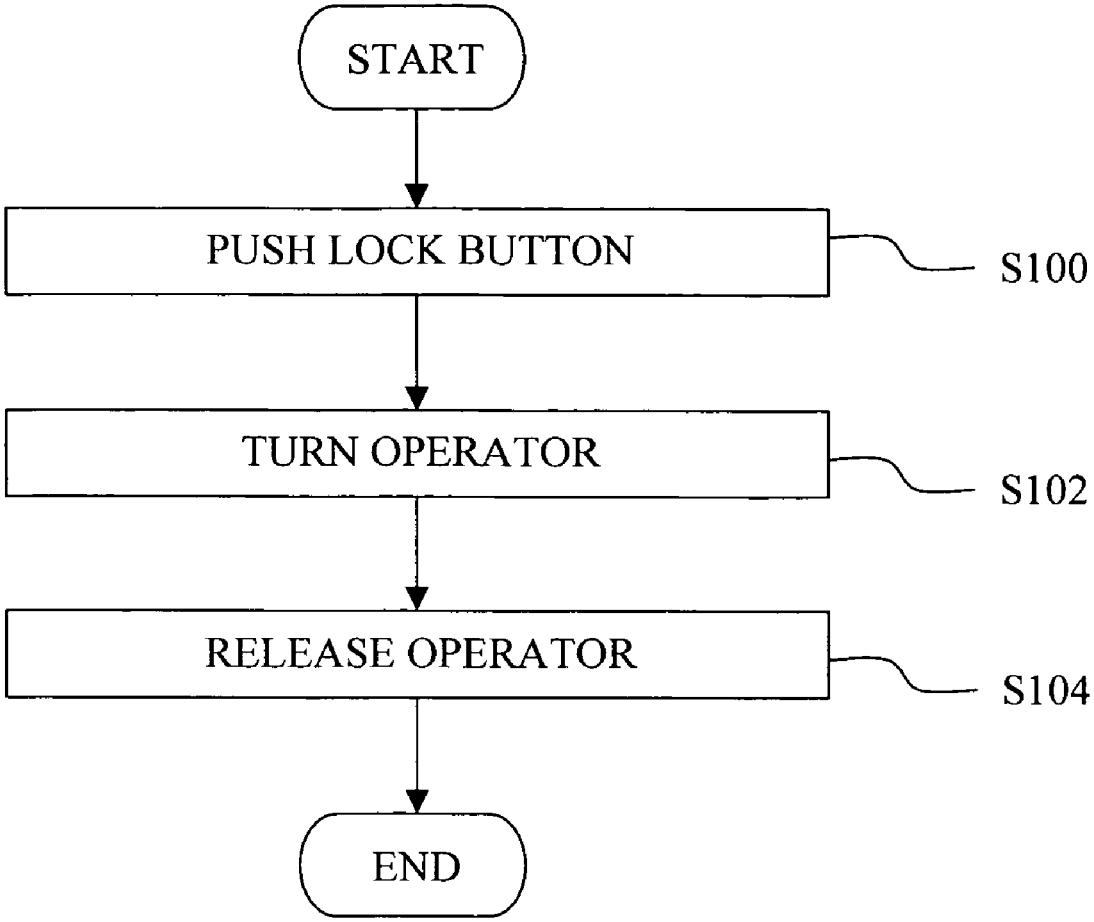
FIG. 5 is a flowchart depicting a method of operating a push button lock mechanism in a handle set in accordance with the present invention.

Referring now to the flowchart of FIG. 5, a method of operating a push button lock mechanism in handle set 10 is now described.

At step S100, the user of handle set 10 pushes lock button 26 to lock push button lock mechanism 11 of handle set 10. Pushing lock button 26 causes spindle guide 16 having kick-off plate 18 coupled thereto to slide into the locked position to lock push button lock mechanism 11, hence handle set 10. Once locked, retention slot 61 of kick-off plate 18 is in engagement with lock retention feature 68 of centralizing cup 20 to thereby retain spindle guide 16 in the locked position.

At step S102, if the user desires to unlock handle set 10, the user turns operator 34 in either of the directions indicated by direction arrow 77 and direction arrow 79 (see FIG. 1) to unlock push button lock mechanism 11. Turning operator 34 causes kick-off plate 18 to kick off of locking cup 24 to drive spindle guide 16 into an unlocked position, aided by the action of shock absorbing spring 30, thereby overcoming lock retention feature 68 engagement with retention slot 61 and unlocking push button lock mechanism 11, hence handle set 10. Rotational stop 14 is engaged by multi-function tang 66 of centralizing cup 20 to limit the rotation of operator 34, for example, to prevent the over extension of torsion spring 22.

At step S104, the user releases operator 34 in order to allow handle set 10 to return to its normal position. Releasing operator 34 causes operator 34 to return to a centralized position under the action of torsion spring 22, wherein each of first end 78 and second end 80 are in at least proximal engagement with both multi-function tang 66 of centralizing cup 20 and post 48 of rose insert 36 to thereby centralize operator 34.

Based on the above description, those skilled in the art would appreciate the simplicity of the present push button lock mechanism design. For example, centralizing cup 20 performs several functions, including piloting torsion spring 22 with mandrel 70, centralizing operator 34 using multi-function tang 66, limiting the rotation of operator 34 using multi-function tang 66, retaining spindle guide 16 in the locked position using lock retention feature 68 in the form of two snap fingers, and rotating kick-off plate 18 via lock retention feature 68 engaging sidewalls 63. Thus, five functions are performed using centralizing cup 20. By using a single component in performing five functions, handle set 10 may have a lower cost than prior art handle sets by eliminating the need for other parts, hence reducing the number of parts required to make handle set 10.

In addition to lower cost, those skilled in the art would appreciate that reducing the number of parts reduces the complexity and hence increases the reliability of handle set 10, as it is known in the art that complexity and reliability are inversely proportional. Hence, the present invention may provide for a handle set of increased reliability.

While this invention has been described with respect to one exemplary embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of operating a push button lock mechanism in a handle set, comprising:

pushing a lock button to cause a spindle guide having a kick-off plate coupled thereto to slide into a locked position to lock said handle set, said kick off plate having a retention slot in engagement with a lock retention feature of a centralizer cup to thereby retain said spindle guide in said locked position; and turning an operator to cause said kickoff plate to kick off of a locking cup to drive said spindle guide into an unlocked position thereby overcoming said lock retention feature engagement with said retention slot and unlocking said handle set, wherein a rotational stop is engaged by a multi-function tang of said centralizer cup to limit a rotation of said operator.

2. The method of claim 1, wherein after said turning of said operator, further comprising:

releasing said operator to cause said operator to return to a centralized position under the action of a torsion spring having a first end and a second end, each of said first end and said second end in at least proximal engagement with both a multi-function tang of said centralizer cup and a post of a rose insert to thereby centralize said operator.

3. The method of claim 2, wherein:

when said operator is turned in a first direction, said multi-function tang rotates in said first direction thereby rotating said first end of said torsion spring in said first direction away from said post and said second end of said torsion spring to wind said torsion spring in said first direction, such that when said operator is released, said torsion spring unwinds to thereby centralize said operator by acting against said multi-function tang with said first end of said torsion spring, said second end of said torsion spring being restrained by said post; and when said operator is turned in a second direction, said multi-function tang rotates in said second direction thereby rotating said second end of said torsion spring in said second direction away from said post and said first end of said torsion spring to wind said torsion spring in said second direction, such that when said operator is released, said torsion spring unwinds to thereby centralize said operator by acting against said multi-function tang with said second end of said torsion spring, said first end of said torsion spring being restrained by said post.

* * * * *